US012130035B2

(12) United States Patent
Iseya

(10) Patent No.: US 12,130,035 B2
(45) Date of Patent: Oct. 29, 2024

(54) SERVER AND INFORMATION PROVIDING SYSTEM

(71) Applicant: Mitsubishi Electric Corporation, Tokyo (JP)

(72) Inventor: Takumi Iseya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 387 days.

(21) Appl. No.: 17/760,862

(22) PCT Filed: Dec. 20, 2019

(86) PCT No.: PCT/JP2019/050099

§ 371 (c)(1),
(2) Date: Mar. 16, 2022

(87) PCT Pub. No.: WO2021/124550

PCT Pub. Date: Jun. 24, 2021

(65) Prior Publication Data

US 2022/0341616 A1 Oct. 27, 2022

(51) Int. Cl.
*F24F 11/49* (2018.01)
*F24F 11/38* (2018.01)

(52) U.S. Cl.
CPC ..... *F24F 11/49* (2018.01); *F24F 11/38* (2018.01)

(58) Field of Classification Search
CPC ..... F24F 11/49; F24F 11/38
(Continued)

(56) References Cited

U.S. PATENT DOCUMENTS 7,013,324 B1 * 3/2006 Sugano ..... G06F 16/9577 707/E17.121
10,610,818 B2 * 4/2020 Fox ..... F24F 11/00
(Continued)

FOREIGN PATENT DOCUMENTS

JP 2002-106930 A 4/2002
JP 2002-297809 A 10/2002
(Continued)

OTHER PUBLICATIONS

International Search Report of the International Searching Authority mailed Feb. 18, 2020, issued in corresponding International Application No. PCT/JP2019/050099 (and English Machine Translation).
(Continued)

*Primary Examiner* — Md Azad
(74) *Attorney, Agent, or Firm* — Posz Law Group, PLC

(57) ABSTRACT

A server includes: a deterioration determining unit that calculates a first timing at which management measures including at least one of check, repair, and replacement of an air conditioner being in use becomes necessary on the basis of state information indicating a state of the air conditioner, and determines whether or not the first timing is within a busy period during which an installation and repair agent is packed with management measures; a timing setting unit that sets a second timing, as a candidate in place of the first timing, in a period other than the busy period when the first timing is within the busy period; and a user notifying unit that notifies an external terminal that the management measures need to be carried out at the second timing.

17 Claims, 5 Drawing Sheets

(58) Field of Classification Search
USPC ..... 700/276
See application file for complete search history.

(56) References Cited

U.S. PATENT DOCUMENTS

| | | | | |
|---|---|---|---|---|
| 2009/0144568 | A1* | 6/2009 | Fung | G06F 1/324 713/300 |
| 2014/0262134 | A1* | 9/2014 | Arensmeier | F24D 5/12 165/11.2 |
| 2018/0012479 | A1* | 1/2018 | Seaton | F24F 11/46 |
| 2018/0202681 | A1* | 7/2018 | Kim | F24F 11/38 |

FOREIGN PATENT DOCUMENTS

| | | | |
|---|---|---|---|
| JP | 2011-226694 | A | 11/2011 |
| JP | 2017-026278 | A | 2/2017 |
| JP | 2017-040449 | A | 2/2017 |

OTHER PUBLICATIONS

Office Action mailed on Jan. 4, 2023 in corresponding JP Patent Application No. 2021-565286 (with English machine translation).

* cited by examiner

SERVER AND INFORMATION PROVIDING SYSTEM

CROSS REFERENCE TO RELATED APPLICATION

This application is a U.S. national stage application of International Patent Application No. PCT/JP2019/050099 filed on Dec. 20, 2019, the disclosure of which is incorporated herein by reference.

TECHNICAL FIELD

The present disclosure relates to a server and an information providing system for providing information on an air conditioner to an external terminal.

BACKGROUND

When an air conditioner goes wrong, the air conditioner is repaired or replaced. In this case, it is difficult for a user to determine which of repair and replacement is appropriate. The user therefore cannot help seeking the advice of an expert such as an installation and repair agent to determine repair or replacement, and it therefore takes trouble and time to determine repair or replacement.

In view of such circumstances, development of technologies for providing information on the operation state of an air conditioner to a user by a system including the air conditioner is in progress. An information management system described in Patent Literature 1 collects operation information from an air conditioner, and displays guide information based on the operation information. The information management system proposes purchase of a replacement to a user by calculating an electricity cost per year or the like in a case where the air conditioner being used is replaced with an air conditioner of a latest model, and informing the user of the cost.

PATENT LITERATURE

Patent Literature 1: Japanese Patent Application Laid-open No. 2011-226694

SUMMARY

The technology of Patent Literature 1, however, is not based on consideration of busy periods of air conditioner installation, and is therefore disadvantageous in not being capable of proposing an appropriate timing for requesting measures for an air conditioner.

The present disclosure is in view of the above, and an object thereof is to provide a server capable of proposing an appropriate timing for requesting measures for an air conditioner.

In order to solve the above-mentioned problem and achieve the object, a server according to the present disclosure includes a determination unit to calculate a first timing at which management measures including at least one of check, repair, and replacement of a first air conditioner being in use becomes necessary on the basis of state information indicating a state of the first air conditioner, and determine whether or not the first timing is within a busy period during which an installation and repair agent is packed with management measures. Additionally, the server according to the present disclosure includes: a timing setting unit to set a second timing, as a candidate in place of the first timing, in a period other than the busy period when the first timing is within the busy period; and a notification unit to notify an external terminal that the management measures need to be carried out at the second timing.

A server according to the present disclosure produces an effect of enabling proposal of an appropriate timing for requesting measures for an air conditioner.

DETAILED DESCRIPTION

A server and an information providing system according to an embodiment of the present disclosure will be described in detail below with reference to the drawings. Note that the present disclosure is not limited to the embodiment.

Embodiment

Figure 1:
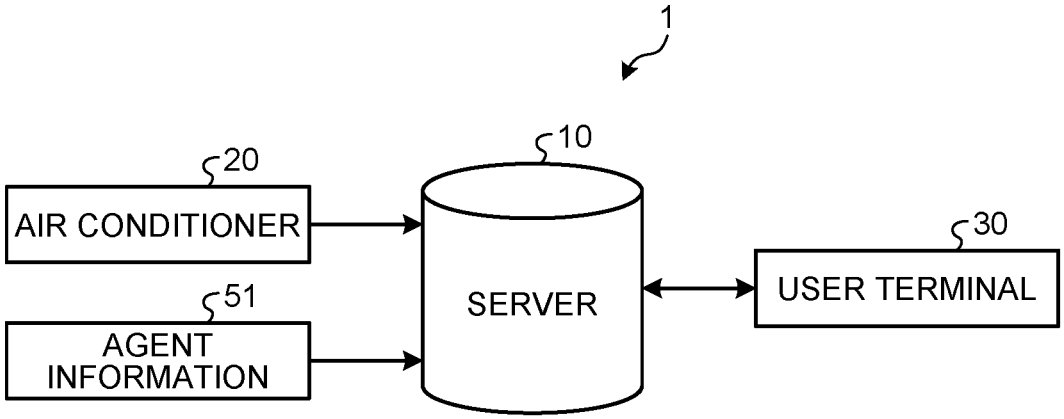
FIG. 1 is a diagram illustrating a configuration of an information providing system including a server according to an embodiment.

FIG. 1 is a diagram illustrating a configuration of an information providing system including a server according to an embodiment. An information providing system 1 includes a server 10, an air conditioner 20, and a user terminal 30, which is an external terminal.

The air conditioner 20 includes various sensors to detect an operation state, an anomalous state, and the like of the air conditioner 20. The air conditioner 20 has a function of transmitting information stored in the air conditioner 20 and information obtained by the air conditioner 20 by using the sensors and the like, to the server 10.

The server 10 can connect with the air conditioner 20 and the user terminal 30 for communication therewith. The server 10 obtains agent information (agent information 51, which will be described later) of an installation and repair agent that carries out installations and repairs of the air conditioner 20. The agent information 51 is information indicating the schedule of the installation and repair agent, the periods during which the installation and repair agent tends to be busy, and the like. The agent information 51 also includes contact information of the installation and repair agent. Examples of the contact information of the installation and repair agent include telephone number and email address.

The server 10 obtains equipment-in-use information (equipment-in-use information 53, which will be described later), which is information on the air conditioner 20, operation state information, which is information on the operation state of the air conditioner 20, and error information, which is information indicating an anomalous state such as failure of the air conditioner 20, from the air conditioner 20.

The server 10 also obtains replacement equipment information (replacement equipment information 52, which will be described later), which is information of an air conditioner (hereinafter referred to as replacement equipment) with which it is proposed that the air conditioner 20 being used should be replaced. The air conditioner 20 that is being used is a first air conditioner, and the replacement equipment is a second air conditioner.

The equipment-in-use information 53 is product information of the air conditioner 20 being used. The equipment-in-use information 53 includes information on the cost per unit period of the air conditioner 20. An example of the cost per unit period is a running cost. The equipment-in-use information 53 also includes information on the date on which the air conditioner 20 was purchased, information on the date on which the air conditioner 20 was installed, and the like.

The replacement equipment information 52 is product information of the replacement equipment. The replacement equipment information 52 includes information on the cost per unit period of the replacement equipment. The replacement equipment information 52 also includes information on the cost for replacement of the air conditioner 20 with the replacement equipment. An example of the unit period herein is a month, a year, or the like.

The server 10 may obtain the agent information 51, the replacement equipment information 52, and the equipment-in-use information 53 by any method. The server 10 may receive the agent information 51 from a terminal at the installation and repair agent, or the agent information 51 may be directly input to the server 10 by an administrator that manages the server 10. In addition, the server 10 may receive the replacement equipment information 52 from an external device or the like, or the replacement equipment information 52 may be directly input to the server 10 by the administrator of the server 10. In addition, the server 10 may receive the equipment-in-use information 53 from the air conditioner 20, or the equipment-in-use information 53 may be directly input to the server 10 by the administrator of the server 10.

The server 10 determines the deterioration level of the air conditioner 20 by using the operation state information. The server 10 determines whether or not notification to the user terminal 30 is necessary by using the equipment-in-use information 53, the result of deterioration determination, the error information, and the agent information 51. A case where notification to the user terminal 30 is necessary is a case where the deterioration level of the air conditioner 20 has exceeded a reference value, a case where an error has occurred in the air conditioner 20, a case where the period of use of the air conditioner 20 has exceeded a reference period, or the like.

When notification to the user terminal 30 is necessary, the server 10 notifies the user terminal 30. The server 10 notifies the user terminal 30 of information for determining whether or not it is better to check or repair the air conditioner 20 or to buy replacement equipment and replace the air conditioner 20 with the replacement equipment. The information for the determination is information on the cost in a case where the air conditioner 20 is checked or repaired, information on the cost in a case where the air conditioner 20 is replaced with the replacement equipment, and the like.

The server 10 also notifies the user terminal 30 of an appropriate timing for requesting a check, a repair, or a replacement of the air conditioner 20. The appropriate timing for the request (request timing) is a timing at which the installation and repair agent can respond to the request.

The user terminal 30 is an external terminal used by a user of the air conditioner 20. Examples of the user terminal 30 include a mobile phone, a smartphone, and a personal computer (PC). The user terminal 30 receives the appropriate request timing for the air conditioner 20 from the server 10. This allows the user of the air conditioner 20 to obtain the appropriate request timing for the air conditioner 20.

Figure 2:
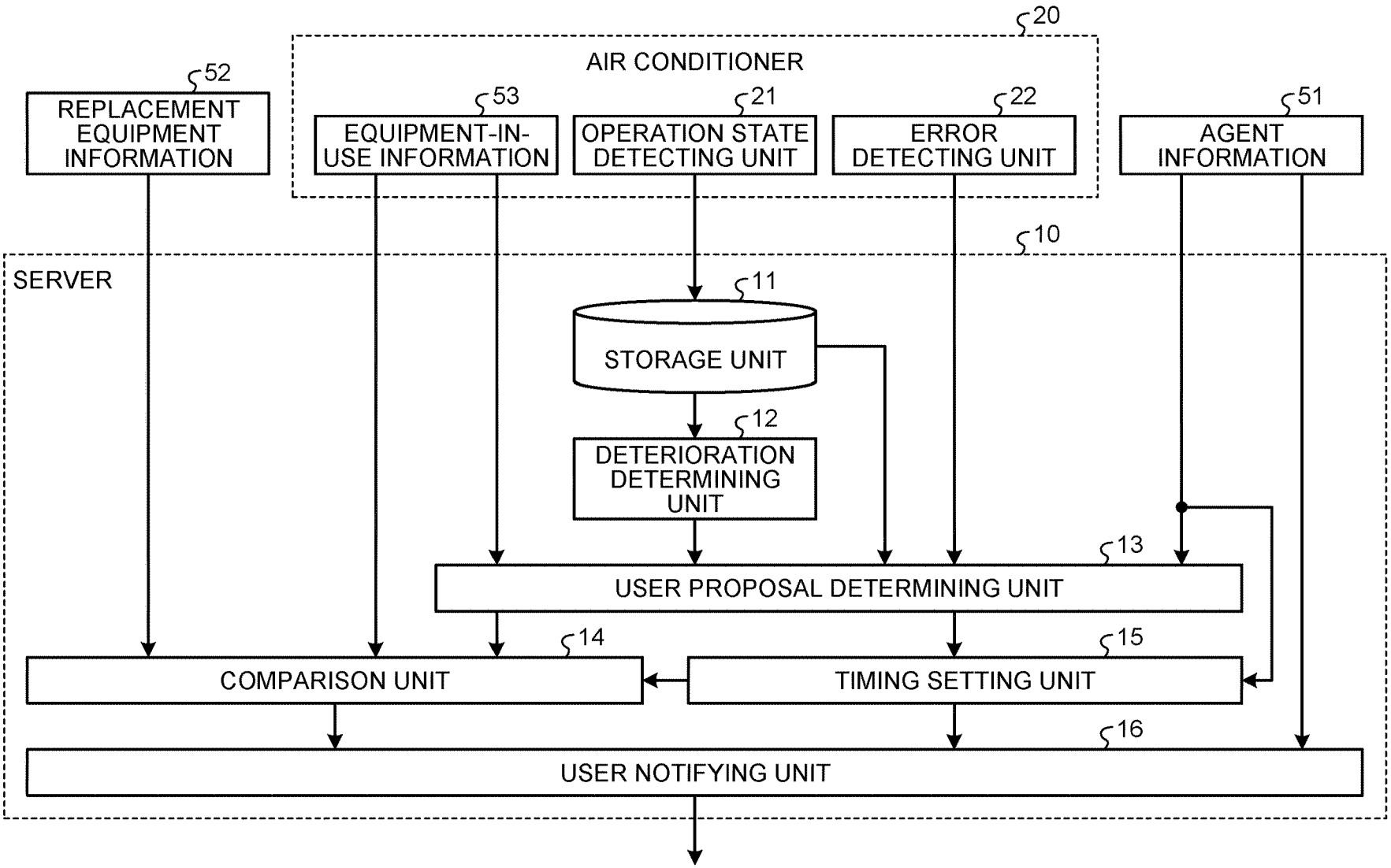
FIG. 2 is a diagram illustrating a configuration of the server according to the embodiment.

FIG. 2 is a diagram illustrating a configuration of the server according to the embodiment. FIG. 2 illustrates a configuration of the server 10, a configuration of the air conditioner 20, the replacement equipment information 52, and the agent information 51.

The server 10 includes a storage unit 11, a deterioration determining unit 12, a user proposal determining unit 13, a comparison unit 14, a timing setting unit 15, and a user notifying unit 16. The air conditioner 20 includes an operation state detecting unit 21, and an error detecting unit 22.

The air conditioner 20 transmits the equipment-in-use information 53 to the user proposal determining unit 13 and the comparison unit 14 of the server 10. Note that the equipment-in-use information 53 may be input to the server 10 from a device other than the air conditioner 20.

The error detecting unit 22 detects an error occurring in the air conditioner 20 by using various sensors. Examples of the error that occurs in the air conditioner 20 includes a temperature error, a voltage error, and the like of the air conditioner 20. The error detecting unit 22 transmits the detected information as error information to the server 10. The error information includes information such as details of the error and the position at which the error has occurred.

The operation state detecting unit 21 detects the operation state information from the air conditioner 20 by using various sensors. The operation state detecting unit 21 detects, as the operation state information, outdoor temperature, indoor temperature, the number of people present in the indoor space, and the like at a time point when the air conditioner 20 has started to operate. The operation state detecting unit 21 also detects, as the operation state information, set temperature, set air volume, set wind direction, and the like of the air conditioner 20 at the time point when the air conditioner 20 has started to operate. The operation state detecting unit 21 transmits the detected operation state information to the server 10. As a result, the storage unit 11 of the server 10 stores the operation state information. Alternatively, the equipment-in-use information 53, the operation state, and the anomalous state may be transmitted to the server 10 by the user terminal 30.

Thereafter, the operation state detecting unit 21 detects the operation state information and transmits the detected operation state information to the server 10 until the indoor temperature reaches the set temperature. In the information providing system 1, the air conditioner 20 detects the operation state information each time the operation of the air conditioner 20 is started, and the storage unit 11 of the server 10 stores the operation state information. As a result, the storage unit 11 obtains and accumulates the operation state information associated with various states of the air conditioner 20 from the air conditioner 20. The storage unit 11 stores the operation state information corresponding to 100 times of operation obtained through 100 times of operation of the air conditioner 20, for example.

The operation state information corresponding to 100 times of operation stored in the storage unit 11 is used as criteria for deterioration determination. When the air conditioner 20 starts operating after the storage unit 11 has accumulated the operation state information corresponding to 100 times of operation, deterioration determination on the air conditioner 20 is performed by the deterioration determining unit 12. The storage unit 11 also stores the operation state information received from the operation state detecting unit 21 when deterioration determination is performed. This operation state information is the operation state information for deterioration determination.

The storage unit 11 is a memory or the like that stores the operation state information corresponding to 100 times of operation transmitted from the operation state detecting unit 21, and the latest (current) operation state information for deterioration determination. The deterioration determining unit 12 reads the operation state information from the storage unit 11, calculates the deterioration state of the air conditioner 20, and determines whether or not deterioration is present.

Specifically, the deterioration determining unit 12 selects operation state information that is closest to the operation state information for deterioration determination from among the operation state information accumulated in the storage unit 11 on the basis of such data as outdoor temperature and indoor temperature stored as operation state information for deterioration determination. Thus, the deterioration determining unit 12 selects operation state information in which the outdoor temperature, the indoor temperature, and the like at a time point when the last operation on which deterioration determination is to be made is started are closest from among the accumulated operation state information. The deterioration determining unit 12 calculates a room temperature arrival time in the selected operation state information. The room temperature arrival time refers to the time taken for the indoor temperature to reach the set temperature. In the description below, the room temperature arrival time in the selected operation state information is also referred to as a reference arrival time.

The deterioration determining unit 12 also calculates a room temperature arrival time in the operation state information for deterioration determination. Thus, when the indoor temperature reaches the set temperature during the current operation, the deterioration determining unit 12 calculates the room temperature arrival time in the current operation.

The deterioration determining unit 12 compares the reference arrival time calculated from the selected operation state information with the room temperature arrival time in the current operation. When the ratio of the room temperature arrival time in the current operation to the reference arrival time becomes a predetermined value or larger, the deterioration determining unit 12 determines that the air conditioner 20 has deteriorated. When the air conditioner 20 is determined to have deteriorated, the deterioration determining unit 12 sends deterioration information indicating a deteriorated state to the user proposal determining unit 13, which is a timing determining unit.

The user proposal determining unit 13 receives the equipment-in-use information 53 from the air conditioner 20. The user proposal determining unit 13 also receives the error information from the error detecting unit 22. The user proposal determining unit 13 also reads the operation state information from the storage unit 11, and receives the deterioration information from the deterioration determining unit 12. The user proposal determining unit 13 also receives the agent information 51 from an external device.

The user proposal determining unit 13 determines whether or not to propose measures such as check, repair, or replacement (replacement purchase) of the air conditioner 20 to the user on the basis of state information indicating the state of the air conditioner 20. The state information includes at least one of the equipment-in-use information 53, the deterioration information, the operation state information, and the error information.

For example, the user proposal determining unit 13 calculates the period from purchase of the air conditioner 20, the period from installation of the air conditioner 20, and the like on the basis of the equipment-in-use information 53. The user proposal determining unit 13 also calculates a total period during which the air conditioner 20 has operated on the basis of the operation state information. In the description below, the period from purchase of the air conditioner 20, the period from installation of the air conditioner 20, or the total period during which the air conditioner 20 has operated may be referred to as an elapsed period.

When the elapsed period exceeds a period being a reference (hereinafter referred to as a reference period), when receiving the error information, or when receiving the deterioration information, the user proposal determining unit 13 determines that it is necessary to propose measures such as check, repair, or replacement to the user. Specifically, when the period from purchase of the air conditioner 20 or the like is a predetermined period or longer, the user proposal determining unit 13 determines that it is necessary to propose measures such as check, repair, or replacement to the user. The measures such as check, repair, or replacement of the air conditioner 20 is to be carried out by the installation and repair agent of the air conditioner 20.

The user proposal determining unit 13 calculates management measure timing (first timing), which is a timing at which measures (management measures) including at least one of check, repair, and replacement becomes necessary, on the basis of the state information of the air conditioner 20.

The user proposal determining unit 13 determines whether or not installation and repair schedule includes a period in a saturated state on the basis of the agent information 51. Specifically, the user proposal determining unit 13 determines whether or not the installation and repair schedule includes a busy period during which there is no time available in the installation and repair schedule of the installation and repair agent. The busy period used herein is a period during which the installation and repair agent does not accept further check, repair, or replacement. In addition, busy periods includes overloaded periods during which the schedule of the installation and repair agent is packed with responses and measures.

When a busy period, which is a crowded period, is included in the installation and repair schedule, the user proposal determining unit 13 determines whether or not the management measure timing is within the busy period on the basis of the agent information 51.

When the management measure timing is determined to be within the busy period, the user proposal determining unit 13 determines during which of a period before the busy period and a period after the busy period the installation and repair agent will be packed with responses and measures, that is, during which of the periods the installation and repair agent is busy with services on the basis of the agent information 51.

When the installation and repair agent is more available during the period before the busy period than during the period after the busy period, the user proposal determining unit 13 makes the elapsed period reach the reference period earlier by making the elapsed period be P times the original period (P is a value larger than 1). As a result, the user proposal determining unit 13 can make the period for measures such as check, repair, or replacement proposed to the user earlier. An example of the value of P is "1.25".

In contrast, when the installation and repair agent is more available during the period after the busy period than during the period before the busy period, the user proposal determining unit 13 makes the elapsed period reach the reference period later by making the elapsed period be Q times the original period (Q is a value smaller than 1 but larger than 0). As a result, the user proposal determining unit 13 can make the period for measures such as check, repair, or replacement proposed to the user later. An example of the value of Q is "0.75".

The user proposal determining unit 13 may determine to propose measures to the user at a time point when the elapsed period reaches the reference period, or may determine to propose measures to the user before the elapsed period reaches the reference period. Specifically, the user proposal determining unit 13 may determine that it is necessary to propose measures such as check, repair, or replacement to the user on a day before the day when the elapsed period is expected to exceed the reference period.

When it is determined to propose measures to the user, the user proposal determining unit 13 sends the management measure timing, as information indicating that it is determined to propose measures to the user, to the comparison unit 14. Note that the user proposal determining unit 13 may send information other than the management measure timing, as information indicating that it is determined to propose measures to the user, to the comparison unit 14.

In addition, when it is determined to propose measures to the user, and if the management measure timing is within a busy period, the user proposal determining unit 13 sends the management measure timing and overlap information indicating that the management measure timing is within the busy period to the timing setting unit 15.

In addition, when it is determined to propose measures to the user, and if the management measure timing is not within a busy period, the user proposal determining unit 13 sends the management measure timing to the timing setting unit 15, but does not send the overlap information to the timing setting unit 15.

As described above, the user proposal determining unit 13 sends the overlap information to the timing setting unit 15 if the management measure timing is within a busy period. In addition, when it is determined to propose measures to the user, the user proposal determining unit 13 sends the management measure timing to the comparison unit 14 and the timing setting unit 15.

The timing setting unit 15 receives the agent information 51 from an external device. Upon receiving the management measure timing and the overlap information from the user proposal determining unit 13, the timing setting unit 15 sets an alternative timing (second timing) as a timing candidate alternative to the management measure timing. Specifically, when the management measure timing is within a busy period, the timing setting unit 15 sets an alternative timing in place of the management measure timing. The alternative timing is set in a period other than the busy period. Specifically, the alternative timing is set to a date and time at which the installation and repair agent can carry out measures such as check, repair, or replacement. The alternative timing is a candidate for a request timing for requesting measures for the air conditioner 20. A plurality of alternative timings may be set.

When the installation and repair agent is more packed with responses and measures in a period before a busy period than in a period after the busy period, the timing setting unit 15 sets an alternative timing to a timing after the busy period. When the installation and repair agent is more packed with responses and measures in a period after a busy period than in a period before the busy period, the timing setting unit 15 sets an alternative timing to a timing before the busy period. When the installation and repair agent is equally packed with responses and measures in a period before a busy period and in a period after the busy period, the timing setting unit 15 may set an alternative timing to either of a timing in the period before the busy period and a timing in the period after the busy period. The timing setting unit 15 sends the set alternative timing to the user notifying unit 16.

In a case where the management measure timing is received from the user proposal determining unit 13 but the overlap information is not received, the timing setting unit 15 sends the management measure timing to the user notifying unit 16.

The comparison unit 14 obtains the equipment-in-use information 53 from the air conditioner 20. The comparison unit 14 also obtains the replacement equipment information 52 from an external device or the like. The comparison unit 14 also receives information indicating that it is determined to propose measures to the user (management measure timing) from the user proposal determining unit 13.

Upon receiving the management measure timing from the user proposal determining unit 13, the comparison unit 14 compares the cost for the air conditioner 20 with the cost for replacement equipment. Specifically, the comparison unit 14 calculates a cost per unit period in a case where the air conditioner 20 is used on the basis of the equipment-in-use information 53. The comparison unit 14 also calculates a cost per unit period in a case where the replacement equipment is used on the basis of the replacement equipment information 52. The comparison unit 14 also calculates a repair cost in a case where the air conditioner 20 is repaired on the basis of at least one of the deterioration information, the operation state information, and the error information. The comparison unit 14 also calculates a replacement cost in a case where the air conditioner 20 is replaced with the replacement equipment on the basis of the replacement equipment information 52.

The comparison unit 14 compares the cost in a case where the air conditioner 20 is checked or repaired with the cost in a case where the air conditioner 20 is replaced with the replacement equipment on the basis of the cost per unit period in a case where the air conditioner 20 is used at the same rate as before, the cost per unit period in a case where the replacement equipment is used at the same rate as the air conditioner 20, the repair cost in the case where the air conditioner 20 is repaired, and the replacement cost in the case where the air conditioner 20 is replaced with the replacement equipment.

Assume that the cost in the case where the air conditioner 20 is checked or repaired is lower than the cost in the case where the air conditioner 20 is replaced with the replacement equipment. The replacement equipment is a new model, and brand-new, and is thus assumed to be more fuel-efficient than the air conditioner 20. The cost per unit period in the case where the replacement equipment is used is therefore lower than the cost per unit period in the case where the air conditioner 20 is used.

The cost for the replacement equipment from the alternative timing in a case where the air conditioner 20 is replaced with the replacement equipment at the alternative timing includes the replacement cost for replacement of the air conditioner 20 with the replacement equipment. The cost for the air conditioner 20 from the alternative timing in a case where the air conditioner 20 is not replaced with the replacement equipment includes the cost for checking or repairing the air conditioner 20. Thus, because the initial replacement cost when the replacement equipment is introduced is high, the cost in the case of replacement with the replacement equipment is higher than in the case where the air conditioner 20 continues to be used. Thereafter, as the replacement equipment continues to be used, the time when the cost in the case of replacement with the replacement equipment becomes lower than the cost in the case where the air conditioner 20 continues to be used comes because the running cost of the replacement equipment is lower than that of the air conditioner 20.

The comparison unit 14 calculates a timing (hereinafter referred to as a cost reversal timing) (third timing) at which the cost for the air conditioner 20 from the alternative timing in the case where the air conditioner 20 is not replaced with the replacement equipment exceeds the cost for the replacement equipment from the alternative timing in the case where the air conditioner 20 is replaced with the replacement equipment at the alternative timing. The comparison unit 14 sends the cost reversal timing to the user notifying unit 16.

When receiving the cost reversal timing and the alternative timing, the user notifying unit 16 transmits these timings to the user terminal 30. When receiving the management measure timing, the user notifying unit 16 transmits the management measure timing to the user terminal 30.

Note that the user notifying unit 16 may transmit the cost per unit period in the case where the air conditioner 20 is used, the cost per unit period in the case where the replacement equipment is used, and the like to the user terminal 30. In addition, the user notifying unit 16 may transmit the repair cost in the case where the air conditioner 20 is repaired, the replacement cost in the case where the air conditioner 20 is replaced with the replacement equipment, and the like to the user terminal 30.

Upon receiving the cost reversal timing, the alternative timing, the management measure timing, and the like, the user terminal 30 displays the received information on a display monitor or the like of the user terminal 30. In a case where a plurality of alternative timings are displayed on the display monitor or the like, the user selects one alternative timing from the alternative timings received by the user terminal 30 to request the installation and repair agent to carry out measures such as check, repair, or replacement at the selected alternative timing. The user may request, on a date before the selected alternative timing, the installation and repair agent to carry out the measures at the selected alternative timing. In addition, when the management measure timing is displayed on the display monitor or the like, whether or not to request the installation and repair agent to carry out measures at the management measure timing is determined by the user. The user's request for measures to the installation and repair agent may be made by the user terminal 30 or with use of a device other than the user terminal 30.

As described above, the server 10 transmits the cost reversal timing to the user terminal 30 to assist the determination of the user on which of continuous use and replacement of the air conditioner 20 is more beneficial to the user.

In a case where the management measure timing is in a busy period, the server 10 proposes an alternative timing of the management measure timing to reduce installations and repairs during busy periods, so that the volumes of installations and repairs can be leveled.

Note that, if requests to the installation and repair agent for carrying out measures for repair or replacement of the air conditioner 20 are made without consideration of the schedule of the installation and repair agent, installations and repairs to be carried out by the installation and repair agent concentrate on busy periods, and services of the installation and repair agent cannot be leveled through the year. In addition, requesting a repair or a replacement during a busy period is disadvantageous for the user in that the period until completion of the repair or the replacement is long.

In the present embodiment, when the installation and repair agent is available in a period before a busy period, the server 10 proposes an alternative timing of the management measure timing in the period before the busy period, which also enables repair of the air conditioner 20 before occurrence of a failure when an error has been found.

Figure 3:
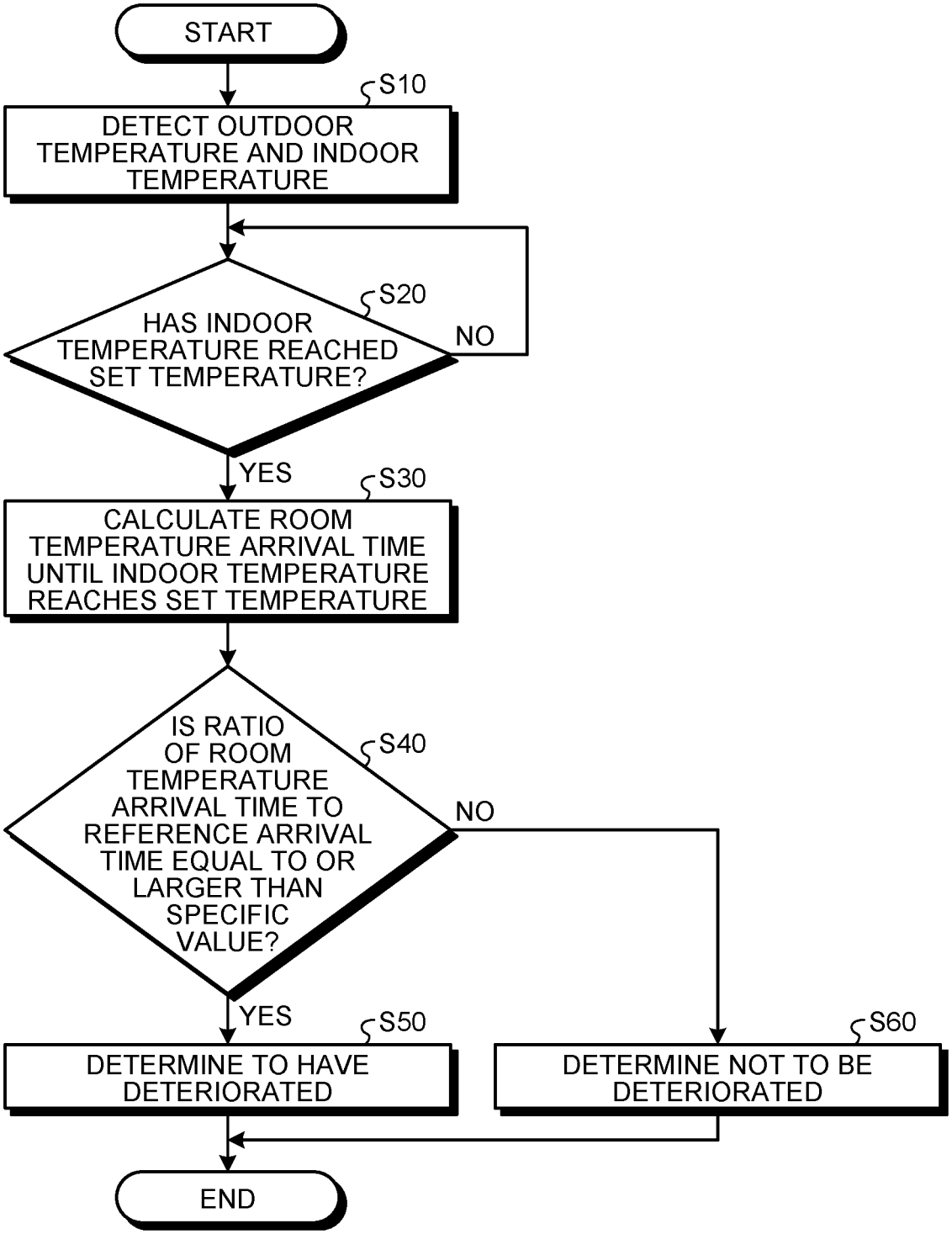
FIG. 3 is a flowchart illustrating procedures of a process of deterioration determination performed by the information providing system according to the embodiment.

FIG. 3 is a flowchart illustrating procedures of a process of deterioration determination performed by the information providing system according to the embodiment. The storage unit 11 of the server 10 stores in advance the operation state information corresponding to 100 times of operation obtained through 100 times of operation of the air conditioner 20, for example.

When the air conditioner 20 starts operating, the operation state detecting unit 21 of the air conditioner 20 detects the outdoor temperature and the indoor temperature (step S10). The detected outdoor temperature and indoor temperature are stored in the storage unit 11. The operation state detecting unit 21 continues detection of the outdoor temperature and the indoor temperature, and the storage unit 11 continues storage of the detected outdoor temperature and indoor temperature.

The deterioration determining unit 12 selects the closest operation state information from among the operation state information accumulated in the storage unit 11 on the basis of the outdoor temperature and the indoor temperature at the start of operation stored in the storage unit 11. The deterioration determining unit 12 calculates the reference arrival time, which is a reference of the room temperature arrival time, on the basis of the selected operation state information.

In addition, when the air conditioner 20 starts operating, the deterioration determining unit 12 determines whether or not the indoor temperature has reached the set temperature (step S20). If the indoor temperature has not reached the set temperature (step S20, No), the deterioration determining unit 12 continues the determination on whether or not the indoor temperature has reached the set temperature (step S20).

If the indoor temperature has reached the set temperature (step S20, Yes), the deterioration determining unit 12 calculates the room temperature arrival time until the indoor temperature reaches the set temperature (step S30). The deterioration determining unit 12 compares the reference arrival time with the room temperature arrival time in the current operation.

The deterioration determining unit 12 determines whether or not the ratio of the room temperature arrival time in the current operation to the reference arrival time is equal to or larger than a specific value (step S40). If the ratio is equal to or larger than the specific value (step S40, Yes), the deterioration determining unit 12 determines that the air conditioner 20 has deteriorated (step S50). If the ratio is smaller than the specific value (step S40, No), the deterioration determining unit 12 determines that the air conditioner 20 is not deteriorated (step S60).

Figure 4:
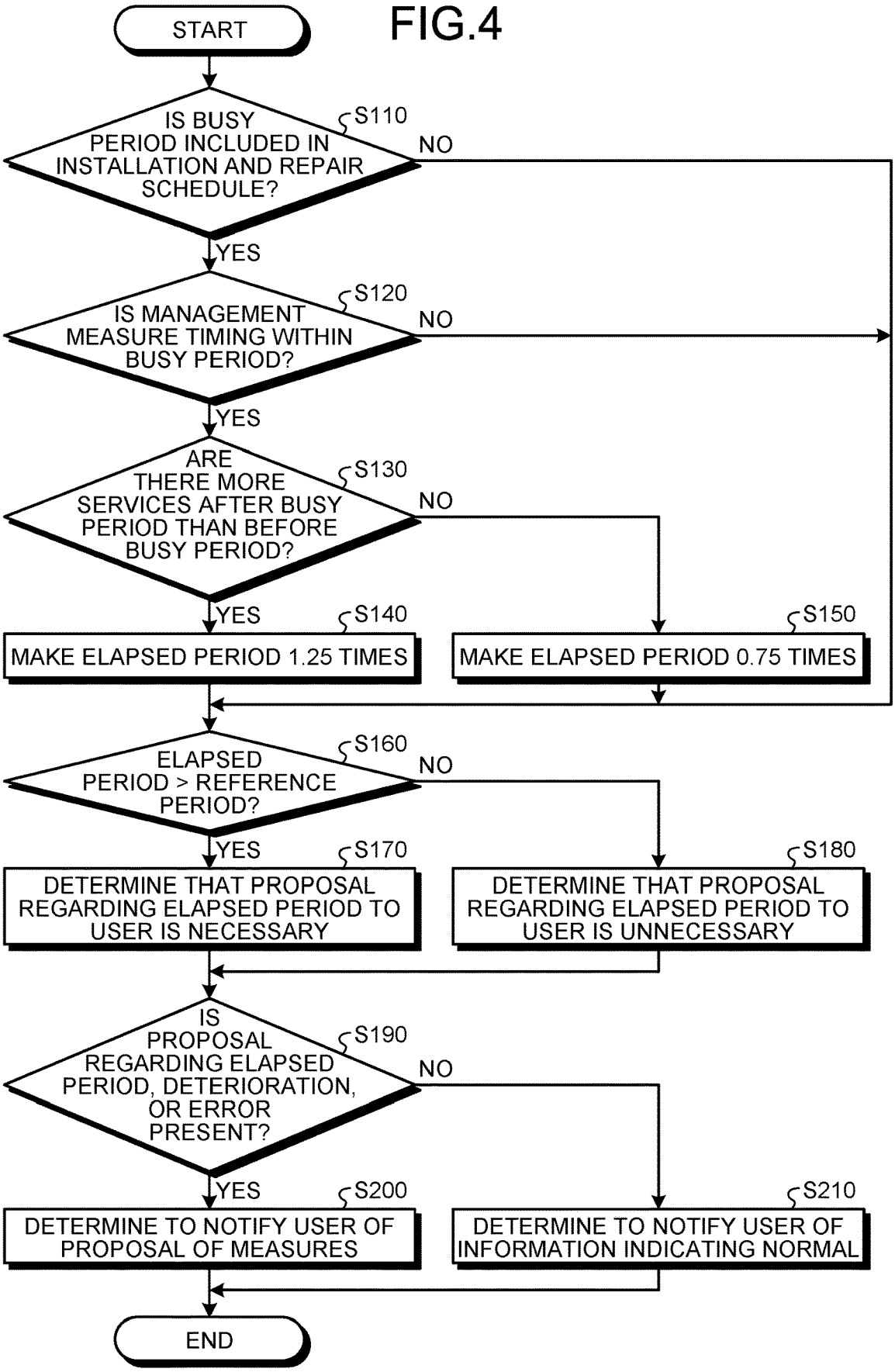
FIG. 4 is a flowchart illustrating procedures of a determination process performed by a user proposal determining unit of the server according to the embodiment.

FIG. 4 is a flowchart illustrating procedures of a determination process performed by the user proposal determining unit of the server according to the embodiment. The user proposal determining unit 13 of the server 10 determines whether or not a busy period is included in the installation and repair schedule on the basis of the agent information 51 (step S110). Specifically, the user proposal determining unit 13 determines whether or not a period during which there is no time available and installations and repairs are saturated is included in the installation and repair schedule on the basis of the agent information 51.

If a busy period is included in the installation and repair schedule (step S110, Yes), the user proposal determining unit 13 determines whether or not the management measure timing is within the busy period (step S120).

If the management measure timing is within the busy period (step S120, Yes), the user proposal determining unit 13 determines whether or not the installation and repair agent is busier with services after the busy period than before the busy period (step S130).

If the installation and repair agent is busier with services after the busy period than before the busy period (step S130, Yes), the user proposal determining unit 13 makes the elapsed period 1.25 times the original period, for example (step S140). If the installation and repair agent is not busier with services after the busy period than before the busy period (step S130, No), the user proposal determining unit 13 makes the elapsed period 0.75 times the original period, for example (step S150). In other words, if the amounts of services of the installation and repair agent are equal before the busy period and after the busy period or if the installation and repair agent is busier with services before the busy period than after the busy period, the user proposal determining unit 13 makes the elapsed period 0.75 times the original period.

After step S140 or S150, the user proposal determining unit 13 determines whether or not the elapsed period is longer than the reference period (step S160). If no busy period is included in the installation and repair schedule in step S110 (step S110, No), the user proposal determining unit 13 determines whether or not the elapsed period is longer than the reference period. In addition, if the management measure timing is not within the busy period in step S120 (step S120, No), the user proposal determining unit 13 determines whether or not the elapsed period is longer than the reference period.

If the elapsed period is longer than the reference period (step S160, Yes), the user proposal determining unit 13 determines that proposal regarding the elapsed period to the user is necessary (step S170).

If the elapsed period is equal to or shorter than the reference period (step S160, No), the user proposal determining unit 13 determines that proposal regarding the elapsed period to the user is unnecessary (step S180).

After step S170 or S180, the user proposal determining unit 13 determines whether or not proposal regarding the elapsed period, deterioration of the air conditioner 20, or an error in the air conditioner 20 is present (step S190).

If proposal regarding the elapsed period, deterioration, or an error is present (step S190, Yes), the user proposal determining unit 13 determines to notify the user of proposal of measures such as check, repair, or replacement (step S200).

If none of proposal regarding the elapsed period, deterioration, and an error is present (step S190, No), the user proposal determining unit 13 determines to notify the user of information indicating normal (step S210). Alternatively, if none of proposal regarding the elapsed period, deterioration, and an error is present, the user proposal determining unit 13 may determine not to notify the user.

Figure 5:
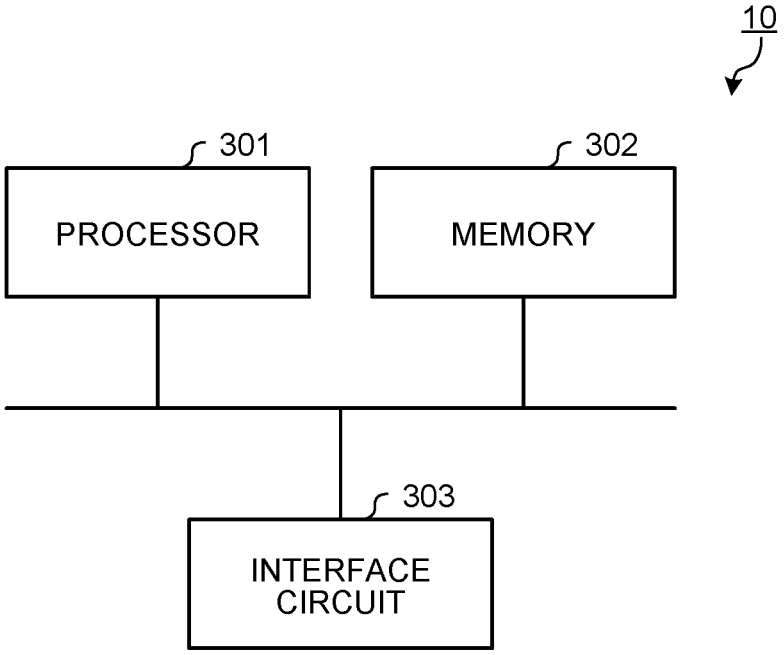
FIG. 5 is a diagram illustrating an example of a hardware configuration of the server according to the embodiment.

A hardware configuration of the server 10 will now be described. FIG. 5 is a diagram illustrating an example of a hardware configuration of the server according to the embodiment. Each of the components of the server 10 can be implemented by a processor 301, a memory 302, and an interface circuit 303.

Examples of the processor 301 include a central processing unit (CPU; also referred to as a central processing device, a processing device, a computing device, a microprocessor, a microcomputer, a processor, or a digital signal processor (DSP)) or a system large scale integration (LSI). Examples of the memory 302 include a random access memory (RAM) and a read only memory (ROM).

The server 10 is implemented by the processor 301 reading and executing information processing programs for performing the operations of the server 10, which are stored in the memory 302. In other words, the information processing programs cause a computer to execute the procedures or the methods of the server 10.

The information processing programs to be executed by the server 10 have a modular structure including the deterioration determining unit 12, the user proposal determining unit 13, the comparison unit 14, the timing setting unit 15, and the user notifying unit 16, which are loaded on a main storage device and generated on the main storage device.

The memory 302 stores the information processing programs, the operation state information, and the like, for example. The memory 302 is also used for a temporary memory when the processor 301 performs various processes.

The information processing programs may be recorded on a computer readable recording medium in a form of files that can be installed or executed, and provided as a computer program product to the server 10. Alternatively, the information processing programs may be provided to the server 10 via a network such as the Internet.

Note that some of the functions of the server 10 may be implemented by dedicated hardware, and others may be implemented by software or firmware. Specifically, some of the components of the server 10 may be implemented by the processor 301 and the memory 302 illustrated in FIG. 5, and the other components may be implemented by dedicated processing circuitry.

As described above, according to the embodiment, the server 10 calculates the management measure timing at which measures for the air conditioner 20 becomes necessary on the basis of the state information of the air conditioner 20, and determines whether or not the management measure timing is within a busy period of the installation and repair agent. When the management measure timing is within the busy period, the server 10 sets, as a candidate in place of the management measure timing, an alternative timing in a period other than the busy period, and notifies the user terminal 30 that measures for the air conditioner 20 at the alternative timing is necessary. As a result, the server 10 can propose an appropriate timing for requesting measures for the air conditioner 20 to the user through the user terminal 30.

The configurations presented in the embodiment above are examples, and can be combined with other known technologies or with each other, or can be partly omitted or modified without departing from the gist.

The invention claimed is:

1. A server comprising:

a processor;

a memory; and an interface circuit, wherein the processor is configured to:

calculate a first timing at which management measures including at least one of check, repair, and replacement of a first air conditioner being in use becomes necessary on the basis of state information indicating a state of the first air conditioner, and determine whether or not the first timing is within a busy period during which an installation and repair agent is packed with management measures; and set a second timing, as a candidate in place of the first timing, in a period other than the busy period when the first timing is within the busy period; and the interface circuit is configured to notify an external terminal that the management measures need to be carried out at the second timing, wherein when the installation and repair agent is busier with management measures in a period before the busy period than in a period after the busy period, the processor sets the second timing in the period after the busy period, and when the installation and repair agent is busier with management measures in the period after the busy period than in the period before the busy period, the processor sets the second timing in the period before the busy period.

2. The server according to claim 1, wherein the state information is information indicating a use period of the first air conditioner or a period from installation of the first air conditioner.

3. The server according to claim 1, wherein:

the processor is further configured to calculate a deterioration state of the first air conditioner on the basis of a history of operation states of the first air conditioner to determine whether or not deterioration is present, and the state information is information indicating the deterioration state.

4. The server according to claim 1, wherein the state information is information indicating an anomalous state of the first air conditioner.

5. The server according to claim 1, wherein:

the processor is further configured to compare a cost for the first air conditioner with a cost for a second air conditioner, the second air conditioner being an air conditioner with which replacement is to be proposed, on the basis of a cost per unit period in a case where the first air conditioner is used, a cost per unit period in a case where the second air conditioner is used, a repair cost in a case where the first air conditioner is repaired, and a replacement cost in a case where the first air conditioner is replaced with the second air conditioner, wherein the interface circuit notifies the external terminal of a result of the comparison.

6. The server according to claim 5, wherein the processor is further configured to calculate a third timing at which the cost for the first air conditioner from the first timing in the case where the first air conditioner is not replaced with the second air conditioner will exceed the cost for the second air conditioner from the first timing in the case where the first air conditioner is replaced with the second air conditioner at the first timing, and the interface circuit notifies the external terminal of the third timing.

7. An information providing system comprising:

an air conditioner; and a server to collect information transmitted from the air conditioner, wherein the server is configured to:

calculate a first timing at which management measures including at least one of check, repair, and replacement of the air conditioner being in use becomes necessary on the basis of state information indicating a state of the air conditioner, and determine whether or not the first timing is within a busy period during which an installation and repair agent is packed with management measures;

set a second timing, as a candidate in place of the first timing, in a period other than the busy period when the first timing is within the busy period; and notify an external terminal that the management measures need to be carried out at the second timing, wherein when the installation and repair agent is busier with management measures in a period before the busy period than in a period after the busy period, the server sets the second timing in the period after the busy period, and when the installation and repair agent is busier with management measures in the period after the busy period than in the period before the busy period, the server sets the second timing in the period before the busy period.

8. The server according to claim 2, wherein the processor is further configured to compare a cost for the first air conditioner with a cost for a second air conditioner, the second air conditioner being an air conditioner with which replacement is to be proposed, on the basis of a cost per unit period in a case where the first air conditioner is used, a cost per unit period in a case where the second air conditioner is used, a repair cost in a case where the first air conditioner is repaired, and a replacement cost in a case where the first air conditioner is replaced with the second air conditioner, wherein the interface circuit notifies the external terminal of a result of the comparison.

9. The server according to claim 3, wherein:

the processor is further configured to compare a cost for the first air conditioner with a cost for a second air conditioner, the second air conditioner being an air conditioner with which replacement is to be proposed, on the basis of a cost per unit period in a case where the first air conditioner is used, a cost per unit period in a case where the second air conditioner is used, a repair cost in a case where the first air conditioner is repaired, and a replacement cost in a case where the first air conditioner is replaced with the second air conditioner, wherein the interface circuit notifies the external terminal of a result of the comparison.

10. The server according to claim 4, wherein:

the processor is further configured to compare a cost for the first air conditioner with a cost for a second air conditioner, the second air conditioner being an air conditioner with which replacement is to be proposed, on the basis of a cost per unit period in a case where the first air conditioner is used, a cost per unit period in a case where the second air conditioner is used, a repair cost in a case where the first air conditioner is repaired, and a replacement cost in a case where the first air conditioner is replaced with the second air conditioner, wherein the interface circuit notifies the external terminal of a result of the comparison.

11. The server according to claim 8, wherein the processor is further configured to calculate a third timing at which the cost for the first air conditioner from the first timing in the case where the first air conditioner is not replaced with the second air conditioner will exceed the cost for the second air conditioner from the first timing in the case where the first air conditioner is replaced with the second air conditioner at the first timing, and the interface circuit notifies the external terminal of the third timing.

12. The server according to claim 9, wherein the processor is further configured to calculate a third timing at which the cost for the first air conditioner from the first timing in the case where the first air conditioner is not replaced with the second air conditioner will exceed the cost for the second air conditioner from the first timing in the case where the first air conditioner is replaced with the second air conditioner at the first timing, and the interface circuit notifies the external terminal of the third timing.

13. The server according to claim 10, wherein the processor is further configured to calculate a third timing at which the cost for the first air conditioner from the first timing in the case where the first air conditioner is not replaced with the second air conditioner will exceed the cost for the second air conditioner from the first timing in the case where the first air conditioner is replaced with the second air conditioner at the first timing, and the interface circuit notifies the external terminal of the third timing.

14. The server according to claim 1, wherein the processor is configured to determine whether or not the first timing is within the busy period based on agent information indicating a schedule of the installation and repair agent.

15. The server according to claim 14, wherein the processor is configured to determine whether or not the schedule of the installation and repair agent includes the busy period.

16. The information providing system according to claim 7, wherein the server is configured to determine whether or not the first timing is within the busy period based on agent information indicating a schedule of the installation and repair agent.

17. The information providing system according to claim 16, wherein the server is configured to determine whether or not the schedule of the installation and repair agent includes the busy period.

* * * * *